US006521588B1

(12) United States Patent
Katoh et al.

(10) Patent No.: US 6,521,588 B1
(45) Date of Patent: Feb. 18, 2003

(54) SOFTENER COMPOSITION

(75) Inventors: Tohru Katoh, Wakayama (JP); Yasuki Ohtawa, Wakayama (JP); Yohei Kaneko, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/700,497

(22) PCT Filed: Jun. 10, 1999

(86) PCT No.: PCT/JP99/03099

§ 371 (c)(1),
(2), (4) Date: Dec. 28, 2000

(87) PCT Pub. No.: WO99/64661

PCT Pub. Date: Dec. 16, 1999

(30) Foreign Application Priority Data

Jun. 11, 1998 (JP) ..... 10/163049

(51) Int. Cl.[7] ..... C11D 1/835

(52) U.S. Cl. ..... 510/515; 510/501; 510/504; 510/505; 510/506

(58) Field of Search ..... 510/501, 504, 510/505, 506, 515, 527

(56) References Cited

U.S. PATENT DOCUMENTS

| | | | | | |
|---|---|---|---|---|---|
| 5,482,635 | A | * | 1/1996 | Behan et al. | 252/8.6 |
| 5,559,088 | A | * | 9/1996 | Severns et al. | 510/102 |
| 5,703,035 | A | | 12/1997 | Birkhan et al. | |
| 6,113,655 | A | * | 9/2000 | Tsunetsugu et al. | 8/137 |
| 6,323,172 | B1 | * | 11/2001 | Trinh et al. | 510/515 |

FOREIGN PATENT DOCUMENTS

| | | | | |
|---|---|---|---|---|
| DE | 42 03 489 | A1 | | 8/1993 |
| EP | 0 409 504 | A2 | | 1/1991 |
| EP | 0 420 465 | A2 | | 4/1991 |
| EP | 0 643 128 | A1 | | 3/1995 |
| EP | 0 669 391 | A2 | | 8/1995 |
| JP | 6-228869 | A | | 8/1994 |
| JP | 7-18577 | | | 1/1995 |
| JP | 07018577 | A | | 1/1995 |
| WO | WO9112364 | A1 | | 8/1991 |
| WO | WO 94/04641 | | | 3/1994 |
| WO | WO 98/06806 | | * | 2/1998 |
| WO | WO 98/12292 | | | 3/1998 |
| WO | WO 99/06509 | | | 2/1999 |

* cited by examiner

*Primary Examiner*—John Hardee
(74) *Attorney, Agent, or Firm*—Birch, Stewart, Kolasch & Birch, LLP

(57) ABSTRACT

The present invention provides a softener composition exhibiting an excellent softening effect and high biodegradability. That is, the present invention provides a softener composition having (A) at least one quaternary ammonium salt having at least two $C_5$–$C_{36}$ alkyl or alkenyl groups which may be interrupted by an ester linkage, amide linkage or ether linkage and (B) a tertiary amino compound (I) a salt thereof or a mixture of the same:

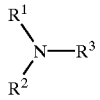

(I)

wherein $R^1$ and $R^2$ represent a $C_1$–$C_3$ alkyl, hydroxyalkyl, aminoalkyl group or the like and $R^3$ represents a $C_5$–$C_{36}$ alkyl group which is interrupted by an ester linkage, amide linkage or ether linkage, or the like.

17 Claims, No Drawings

SOFTENER COMPOSITION

This application is the national phase under 35 U.S.C. § 371 of PCT International Application No. PCT/JP99/03099 which has an International filing date of Jun. 10, 1999, which designated the United States of America.

TECHNICAL FIELD

The present invention relates to a softener composition.

BACKGROUND ART

Most of the commercially available merchandise as a softener composition for fibers are compositions comprising a quaternary ammonium salt containing two long-chain alkyl groups in one molecule and being typified by a di(long-chain alkyl) dimethyl ammonium chloride.

However, the quaternary ammonium salt described above suffers from the problem that, when residues thereof after a treatment is discharged into the environment such as a river, most of them are accumulated without biodegradation.

As an improved product against the above-mentioned problem, N-methyl-N,N-bis(long-chain alkanoyloxyethyl)-N-(2-hydroxyethyl) ammonium methyl sulfate, N,N-dimethyl-N,N-bis(alkanoyloxyethyl) ammonium chloride or the like is commercially available. Although the biodegradability of these products is improved as compared with that of the quaternary ammonium salt described above, the improved products cannot be said to be a basis for sufficiently satisfying a softening effect.

DISCLOSURE OF INVENTION

Accordingly, the object of the present invention is to provide a softener composition exhibiting an excellent softening effect and a high biodegradability and preventing a creaky feeling (or creaky feeling).

The present inventors have found that a quaternary ammonium salt having at least two long-chain alkyl groups is combined with a specific amino compound or a salt thereof, whereby the problem described above can be solved. Then, they have completed the present invention.

That is, the present invention provides a softener composition comprising the following components (A) and (B):

(A) at least one quaternary ammonium salt having at least two C5–$C_{36}$ alkyl or alkenyl groups which may be interrupted by an ester linkage, amide linkage or ether linkage, and (B) a tertiary amino compound represented by the following formula (I), a salt thereof or a mixture of the same:

(I)

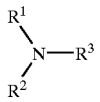

wherein $R^1$ and $R^2$ are the same or different and each of $R^1$ and $R^2$ represents a $C_1$–$C_3$ alkyl, hydroxyalkyl or aminoalkyl group or —$(AO)_nH$, in which A represents an ethylene or propylene group and n is a number selected from 1 to 10, and $R^3$ represents a $C_5$–$C_{36}$ alkyl or alkenyl group which is interrupted by an ester linkage, amide linkage or ether linkage (or into which an ester-, amide- or ether-bonding group is inserted).

In the component (A), the amount of the quaternary ammonium salt having at least three $C_5$–$C_{36}$ alkyl or alkenyl groups which may be interrupted by an ester linkage, amide linkage or ether linkage is preferably at least 25% by weight and more preferably at least 50% by weight.

Then, it is preferable that the quaternary ammonium salt having at least three alkyl or alkenyl groups in the component (A) is preferably one having three alkyl or alkenyl groups.

The ratio of the component (A) to the component (B) by weight is preferably from 1/9 to 9/1.

The component (A) is preferably a quaternary ammonium salt having at least one ester linkage.

Further, it is preferable that the total content of the components (A) and (B) is 3 to 50% by weight and a liquid carrier is further contained therein.

Preferable Modes for Carrying Out the Invention

The component (A) in the present invention is preferably represented by the following formula (II) or (III) or a mixture thereof:

(II)

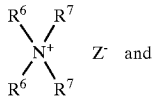

(III)

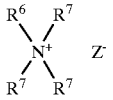

wherein $R^6$ represents a $C_1$–$C_3$ alkyl or hydroxyalkyl group, $R^7$ represents a $C_6$–$C_{36}$ alkyl or alkenyl group or —$C_mH_{2m}$—X—$R^8$, m is an integer of 1 to 6, X is —OCO—, —COO—, —NHCO—, —CONH— or —O—, $R^8$ represents a $C_5$–$C_{35}$ alkyl or alkenyl group, $Z^-$ represents an anion, provided that the two groups selected from $R^6$'s and $R^7$'s may be the same or different.

The ratio of (II)/(III) is preferable 3/1 to 9/1 and more preferably 1/1 to 9/1.

Among them, it has more preferably at least one ester group and is further preferably represented by the following formulae (IIa) and (IIIa) or (IIb) and (IIIb):

(IIa)

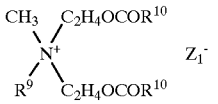

(IIIa)

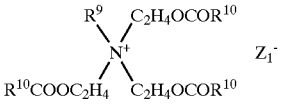

wherein $R^9$ represents a methyl or hydroxyethyl group, $R^{10}$ represents a $C_5$–$C_{21}$ alkyl or alkenyl group, and $Z_1^-$ represents a chloride ion ($Cl^-$) or methyl sulfate ion;

(IIb)

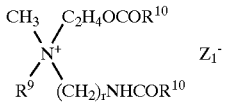

-continued (IIIb)

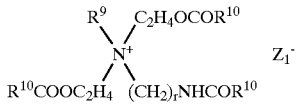

wherein each of $R^9$, $R^{10}$ and $Z_1^-$ has the same meaning as defined above and r is 2 or 3.

For example, the compounds represented by the formula (II*a*) and (III*a*) or (II*b*) and (III*b*) are synthesized by acylation of an amino alcohol such as triethanolamine, N-methyldiethanolamine, N-methyl-N-(2-hydroxyethyl) propanediamine and N,N-di(2-hydroxyethyl) propanediamine with a fatty acid or a lower alkyl ester thereof and further quaternarization of the resultant product with a quaternarizing agent such as methyl chloride (or chloromethane) and dimethyl sulfate. The degree of acylation in total is preferably 1.1 to 3.0 and more preferably 1.5 to 3.0. The fatty acid or the lower alkyl ester thereof for use is preferably a fatty acid from a coconut, a tallow fatty acid, a hardened (or hydrogenated) tallow fatty acid, stearic acid from a palm, hardened stearic acid from a palm or a lower alkyl ester thereof is particularly preferable. Further, a fat and/or oil such as a coconut oil, a tallow, a hardened tallow, a palm-stearin and a hardened palm-stearin may be used. Although the obtainable product contains compound having one, two, or three or more members selected from long-chain alkyl and alkenyl groups, depending on the amino alcohol for use, it is more than enough that the obtainable product is used as it is.

In the component (B) in the present invention, each of $R^1$, $R^2$ and $R^3$ in the amino compound represented by the formula (I) has the above-defined meaning, but it is preferable that each of $R^1$ and $R^2$ represents a $C_1$–$C_3$ alkyl or hydroxyalkyl group. $R^3$ is preferably a $C_7$–$C_{22}$ alkyl or alkenyl group which is interrupted by an ester linkage, amide linkage or ether linkage and more preferably the group which is interrupted by an ester linkage or amide linkage. It is particularly preferably an alkanoyl or alkenoyloxyethyl group, an alkanoyl or alkenoylaminoethyl group, or an alkanoyl or alkenoyl aminopropyl group.

The salt of the amino compound can be synthesized in a usual manner by neutralization with an inorganic or organic acid such as hydrochloric acid (an aqueous solution of hydrogen chloride), sulfuric acid, acetic acid, glycolic acid and citric acid.

In the composition of the present invention, the blending ratio of the component (A) to the component (B) by weight is preferably from 1/6 to 9/1 and, from the standpoint of an excellent softening performance, more preferably 3/7 to 7/3.

The components (A) and (B) can be formed into the liquid softener composition by dispersing them in a total amount of 3 to 50% by weight in a liquid carrier such as water. In this case, the components (A) and (B) may be beforehand mixed and then introduced into water or they may be introduced one after another into water. Alternatively, the respective components maybe separately dispersed in water and then mixed.

A dispersion with water of the softener composition of the present invention has preferably pH 2 to 5 in view of a dispersibility and storage stability of the amino compound.

A higher alcohol or higher fatty acid can be added in order to further improve a softening performance. A lower alcohol such as ethanol and isopropanol, glycol or polyol as well as ethylene oxide or propylene oxide adduct can be added as a storage stabilizer. Furthermore, a usual nonionic surfactant, an inorganic salt, a pH adjuster, a hydrotropic agent, a perfume, a defoaming agent, a pigment and the like can be added if necessary.

EXAMPLES

Examples 1–1 to 1–7

(A-1) a quaternary product by dimethyl sulfate of a reacted product of triethanolamine with a tallow fatty acid at the molar ratio of 1:1.9 was used as the component (A), while (B-1) N-(3-hardened tallow alkanoylaminopropyl)-N, N-dimethylamine was used as the component (B). They were dispersed in water in blending amounts shown in Table 1, and then the resultant dispersion was adjusted to pH 2.5 by dropwise adding hydrochloric acid to obtain each of various softener compositions. Each of the compositions was evaluated for a softening effect in the following manner. The results are shown in Table 2.

<A method of evaluating a softening effect>

① A mixture of the components (A) and (B) was molten and added dropwise to water under stirring. Then, an inorganic or organic acid was added dropwise thereto to prepare a dispersion having a predetermined solid content and pH. As a comparative control sample, a 5% dispersion of N-methyl-N,N-bis(tallow alkanoyl oxyethyl)-N-(2-hydroxyethyl) ammonium methyl sulfate was prepared in the same manner as above.

Here, it is not essential that the dispersion is acidic but the pH is preferably 2 to 5 from the viewpoint of a dispersibility and storage stability as described above.

② A treating method 2 kg of commercially available cotton towels or 2 kg of jersey cloths made of acrylate fibers were laundered repeatedly 5 times with a commercially available detergent "Attack" (a registered trade mark, manufactured by Kao Corporation) in hard water of 3.5° DH in a laundering machine having its capacity of 30 liter. Then, 25 ml of the above dispersion were introduced therein and the resultant mixture was treated under stirring at 25 ° C. for 1 minute.

③ A method for evaluating a softening effect and feeling of touch of clothes

Cloths treated in the method described above were air-dried at room temperature and then left in a constant temperature and humidity chamber at 25° C. under 65% RH for 24 hours. These cloths were evaluated for a softening effect. A cloth treated with N-methyl-N,N-bis(tallow alkanoyloxyethyl)-N-(2-hydroxyethyl) ammonium methyl sulfate was used as the control for evaluation by the period comparison test. The evaluations of a softening effect and feeling of touch of clothes are shown using the following criteria. For a feeling of touch of the clothes, "+" was assigned when the jersey cloth made of acrylate fibers was less creaky than the control, and was assigned when it was more creaky than the control. 2: Harder than the control or more creaky than the control.

Examples 2 to 13

In the same manner as in Example 1, the components (A) and (B) shown in Table 1 were dispersed in water in amounts shown in Table 1, then the resultant mixture was adjusted to pH shown in Table 1 with an acid described in Table 1, and the resultant composition was evaluated for a softening effect and feeling of touch of clothes in the same manner as in Example 1. The results are shown in Table 2.

Comparative Examples 1 to 6

As shown in Table 1, either the component (A) or the component (B) was dispersed in water in an amount shown in Table 1 and then adjusted if necessary to pH shown in Table 1 with an acid described in Table 1, and the resultant composition was evaluated for a softening effect and feeling of touch of clothes in the same manner as in Example 1. The results are shown in Table 2.

TABLE 1

| | | The component (A) | | The component (B) | | | |
|---|---|---|---|---|---|---|---|
| | | Kind | Amount (% by weight) | Kind | Amount (% by weight) | Inorganic or organic acid | pH |
| Examples | 1-1 | A-1 | 4.5 | B-1 | 0.5 | Hydrochloric acid | 2.5 |
| | 1-2 | A-1 | 4.0 | B-1 | 1.0 | Hydrochloric acid | 2.5 |
| | 1-3 | A-1 | 3.5 | B-1 | 1.5 | Hydrochloric acid | 2.5 |
| | 1-4 | A-1 | 2.5 | B-1 | 2.5 | Hydrochloric acid | 2.5 |
| | 1-5 | A-1 | 2.0 | B-1 | 3.0 | Hydrochloric acid | 2.5 |
| | 1-6 | A-1 | 1.0 | B-1 | 4.0 | Hydrochloric acid | 2.5 |
| | 1-7 | A-1 | 0.5 | B-1 | 4.5 | Hydrochloric acid | 2.5 |
| | 2 | A-2 | 2.5 | B-1 | 2.5 | Hydrochloric acid | 2.2 |
| | 3 | A-3 | 2.5 | B-1 | 2.5 | Glycolic acid | 4.2 |
| | 4 | A-4 | 2.5 | B-1 | 2.5 | Glycolic acid | 4.5 |
| | 5 | A-1 | 2.5 | B-2 | 2.5 | Citric acid | 4.5 |
| | 6 | A-1 | 2.5 | B-3 | 2.5 | Citric acid | 4.5 |
| | 7 | A-1 | 2.5 | B-4 | 2.5 | Sulfuric acid | 3.0 |
| | 8 | A-1 | 2.5 | B-5 | 2.5 | Sulfuric acid | 3.0 |
| | 9 | A-1 | 2.5 | B-6 | 2.5 | Sulfuric acid | 3.0 |
| | 10 | A-5 | 2.5 | B-1 | 2.5 | Hydrochloric acid | 2.5 |
| | 11 | A-6 | 2.5 | B-1 | 2.5 | Hydrochloric acid | 2.5 |
| | 12 | A-7 | 2.5 | B-2 | 2.5 | Hydrochloric acid | 2.5 |
| | 13 | A-8 | 2.5 | B-2 | 2.5 | Hydrochloric acid | 2.5 |
| Comparative Examples | 1 | A-1 | 5.0 | | | | 3.6 |
| | 2 | A-2 | 5.0 | | | | 3.8 |
| | 3 | A-4 | 5.0 | | | | 3.5 |
| | 4 | | | B-1 | 5.0 | Hydrochloric acid | 2.5 |
| | 5 | | | B-2 | 5.0 | Hydrochloric acid | 2.5 |
| | 6 | | | B-7 | 5.0 | Hydrochloric acid | 2.5 |

Description of the abbreviations in Table 1

A-1: A quaternary product by dimethyl sulfate of a reacted product of triethanolamine with a tallow fatty acid at the molar ratio of 1:1.9 (wherein dialkyl/trialkyl=56/44 by weight).

A-2: A quaternary product by methyl chloride of a reacted product of methyldiethanolamine with a hardened tallow fatty acid at the molar ratio of 1:2 (wherein dialkyl/trialkyl=100/0 by weight). weight).

A-3: A quaternary product by methyl chloride of a reacted product of N-(2-hydroxyethyl)-N-methylpropanediamine with a hardened tallow fatty acid at the molar ratio of 1:2 (wherein dialkyl/trialkyl=100/0 by weight).

A-4: A quaternary product by dimethyl sulfate of a reacted product of N,N-di(2-hydroxyethyl)propanediamine with a hardened tallow fatty acid at the molar ratio of 1:2.2 (wherein dialkyl/trialkyl=57/43 by weight).

A-5: A quaternary product by dimethyl sulfate of a reacted product of triethanolamine with a tallow fatty acid at the molar ratio of 1:2.3 (wherein dialkyl/trialkyl=40/60 by weight).

A-6: A quaternary product by dimethyl sulfate of a reacted product of triethanolamine with a tallow fatty acid at the molar ratio of 1:3.0 (wherein dialkyl/trialkyl=0/100 by weight).

A-7: A quaternary product by dimethyl sulfate of a reacted product of N, N-di (2-hydroxyethyl) propanediamine with a hardened tallow fatty acid at the molar ratio of 1:3.0 (wherein dialkyl/trialkyl=0/100 by weight).

A-8: A quaternary product by dimethyl sulfate of a reacted product of N,N-di(2-hydroxyethyl)ethylenediamine with a hardened tallow fatty acid at the molar ratio of 1:3.0 (wherein dialkyl/trialkyl=0/100 by weight).

B-1: N-(3-hardened tallow alkanoylaminopropyl)-N,N-dimethylamine.

B-2: N-(3-tallow alkanoylaminopropyl)-N-(2-hydroxyethyl)-N-methylamine.

B-3: N-(3-hardened palm-stearoyl aminopropyl)-N,N-di (2-hydroxyethyl)amine.

B-4: N-(2-hardened tallow alkanoyloxyethyl)-N,N-dimethylamine.

B-5: A reacted product of methyldiethanolamine with a hardened tallow fatty acid at the molar ratio of 1:1.

B-6: A reacted product of triethanolamine with tallow fatty acid at the molar ratio of 1:1.

B-7: A condensed (or concentrated) cyclic product with aminoethyl ethanolamine of a hardened tallow fatty acid.

A dialkyl or trialkyl form of the component (A) as mentioned above was analyzed using the following column, eluent and detector in a liquid chromatography.

Column: Wakosil-II 5C18HG, ϕ4.0 mm×250 mm, Wako Pure Chemical Industries, Ltd.

Eluent: a 1% phosphoric acid, ethanol/isopropyl alcohol=95/5 (vol/vol) solution.

Detector: UV 215 nm.

TABLE 2

| No. of Examples and Comparative Examples | | Result of evaluation for softening effect | | Prohibition of creaky feeling |
|---|---|---|---|---|
| | | Cotton towels | Jersey cloths made of acrylate fibers | |
| Examples | 1-1 | +1 | +1 | 0 |
| | 1-2 | +1 | +1 | 0 |
| | 1-3 | +2 | +2 | +1 |
| | 1-4 | +2 | +2 | +1 |
| | 1-5 | +2 | +2 | +1 |
| | 1-6 | +1 | +1 | +1 |
| | 1-7 | +1 | +1 | +1 |
| | 2 | +2 | +2 | 0 |
| | 3 | +1 | +2 | 0 |
| | 4 | +1 | +2 | 0 |
| | 5 | +1 | +2 | 0 |

TABLE 2-continued

| No. of Examples and Comparative Examples | | Result of evaluation for softening effect: Cotton towels | Jersey cloths made of acrylate fibers | Prohibition of creaky feeling |
|---|---|---|---|---|
| | 6 | +1 | +1 | 0 |
| | 7 | +1 | +2 | 0 |
| | 8 | +1 | +1 | 0 |
| | 9 | +1 | +1 | 0 |
| | 10 | +2 | +2 | +2 |
| | 11 | +2 | +2 | +2 |
| | 12 | +2 | +2 | +2 |
| | 13 | +2 | +2 | +2 |
| Comparative Examples | 1 | 0 | 0 | 0 |
| | 2 | +1 | −1 | 0 |
| | 3 | +1 | −1 | 0 |
| | 4 | −2 | −2 | −2 |
| | 5 | −2 | −2 | −2 |
| | 6 | −2 | −2 | −2 |

The compositions in examples 1–3 to 1–5 and 10 to 13 are the most preferable in Examples described above.

It is recognized that the composition of the present invention has an excellent softening performance when the ratio of the component (A) to the component (B) by weight is in the range of 1/9 to 9/1 further excellent softening performance in the range of 3/7 to 7/3.

What is claimed is:

1. A softener composition comprising the following components (A) and (B):

(A) at least one quaternary ammonium salt having at least two $C_5$–$C_{36}$ alkyl or alkenyl groups optionally interrupted by an ester linkage, amide linkage or ether linkage, and (B) a tertiary amino compound represented by the following formula (I), a salt thereof or a mixture of the same:

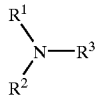

(I)

wherein $R^1$ and $R^2$ are the same or different from each other, and each of $R^1$ and $R^2$ represents a $C_1$–$C_3$ alkyl, hydroxyalkyl or aminoalkyl group or —$(AO)_nH$, in which A represents an ethylene or propylene group and n is a number selected from 1 to 10, and $R^3$ represents a $C_{14}$–C36 alkyl or alkenyl group which is interrupted by an ester linkage, amide linkage or ether linkage.

2. The softener composition as claimed in claim 1, wherein the amount of the quaternary ammonium salt having at least three $C_5$–$C_{36}$ alkyl or alkenyl groups optionally interrupted by an ester linkage, amide linkage or ether linkage is at least 25% by weight in the component (A).

3. The softener composition as claimed in claim 1, wherein the component (A) is the quaternary ammonium salt having three C5–C36 alkyl or alkenyl groups optionally interrupted by an ester linkage, amide linkage or ether linkage.

4. The softener composition as claimed in claim 1, wherein the ratio of the component (A) to the component (B) by weight is from 1/9 to 9/1.

5. The softener composition of claim 4, wherein said ratio of the component (A) to the component (B) by weight is from 3/7 to 7/3.

6. The softener composition as claimed in claim 1, wherein the component (A) is quaternary ammonium salt having at least one ester linkage.

7. The softener composition as claimed in claim 1, wherein the total content of the components (A) and (B) is 3 to 50% by weight and a liquid carrier is further contained therein.

8. The softener composition of claim 7, wherein said liquid carrier is water.

9. The softener composition of claim 1, wherein each of said $R^1$ and R2 of component (B) is a $C_1$–$C_3$ alkyl or hydroxy alkyl group.

10. The softener composition of claim 1, wherein said $R^3$ of component (B) is a $C_{14}$–$C_{22}$ alkyl or alkenyl group.

11. The softener composition of claim 1, further comprising a higher alcohol or a higher fatty acid.

12. The softener composition of claim 1, further comprising at least one ingredient selected from the group consisting of a nonionic surfactant, an inorganic salt, a pH adjuster, a hydrotropic agent, a perfume, a defoaming agent and a pigment.

13. The softener composition of claim 1, wherein said component (A) is a) a compound represented by formula (II):

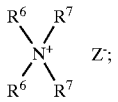

(II)

b) a compound represented by formula (III):

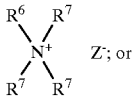

(III)

c) a mixture of the compounds of formula (II) and formula (III);

wherein for each compound of formula (II) or formula (III), $R^6$ represents a $C_1$–$C_3$ alkyl or hydroxyalkyl group;

$R^7$ represents a $C_6$–$C_{36}$ alkyl or alkenyl group or —$C_mH_{2m}$—X—$R^8$, wherein m is an integer of 1 to 6, X is —OCO—, —COO—, —NHCO—, —CONH—or —O—, $R^8$ represents a $C_5$–$C_{35}$ alkyl or alkenyl group; and $Z^-$ represents an anion.

14. The softener composition of claim 13, wherein said mixture of compounds of formula (II) and (III) is a ratio of (II)/(III), wherein said ratio is 3/1 to 9/1.

15. The softener composition of claim 13, wherein said compound of formula (II) is

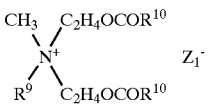

(IIa)

or (IIb)

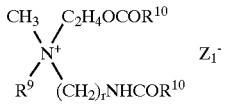

wherein $R^9$ represents a methyl or hydroxylethyl group, $R^{10}$ represents a $C_5$–$C_{21}$ alkyl or alkenyl group, and $Z_1^-$ represents a chloride ion ($Cl^-$) or methyl sulfate ion.

16. The softener composition of claim 13, wherein said compound of formula (III) is (IIIa)

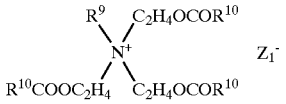

or (IIIb)

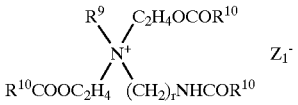

wherein each of $R^9$, $R^{10}$ and $Z_1^-$ has the same meaning as defined above and r is 2 or 3.

17. A softener composition comprising:

(A) at least one quaternary ammonium salt having at least two $C_5$–$C_{36}$ alkyl or alkenyl groups optionally interrupted by an ester linkage, amide linkage or ether linkage;

(B) a tertiary amino compound represented by the following formula (I), a salt thereof or a mixture of the same:

(I)

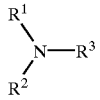

wherein $R^1$ and $R^2$ are the same or different from each other, and each of $R^1$ and $R^2$ represents a $C_1$–$C_3$ alkyl, hydroxyalkyl or aminoalkyl group or —$(AO)_nH$, in which A represents an ethylene or propylene group and n is a number selected from 1 to 10, and $R^3$ represents a $C_{14}$ –$C_{36}$ alkyl or alkenyl group which is interrupted by an ester linkage, amide linkage or ether linkage; and (C) a liquid carrier;

wherein said softener composition has a pH of 2 to 5.

* * * * *